US005893285A

United States Patent [19]

Athanassiou

[11] Patent Number: 5,893,285

[45] Date of Patent: Apr. 13, 1999

[54] LOCK CYLINDER

[76] Inventor: George Athanassiou, 2719 Voorhies Ave., Brooklyn, N.Y. 11235

[21] Appl. No.: 09/021,263

[22] Filed: Feb. 10, 1998

[51] Int. Cl.[6] ..... E05B 27/00

[52] U.S. Cl. ..... 70/493; 70/358; 70/495

[58] Field of Search ..... 70/493, 356, 358, 70/495, 496, 386, 419–421

[56] References Cited

U.S. PATENT DOCUMENTS

| | | | |
|---|---|---|---|
| 2,149,733 | 3/1939 | Hagendorn | 70/364 |
| 2,754,673 | 7/1956 | Schachinger | 70/383 |
| 3,303,677 | 2/1967 | Bauer | 70/358 |
| 3,479,849 | 11/1969 | Check | 70/495 |
| 4,103,526 | 8/1978 | Surko, Jr. | 70/364 |
| 4,196,604 | 4/1980 | Vorob | 70/358 |
| 4,221,121 | 9/1980 | Tietz | 70/358 |
| 4,612,787 | 9/1986 | Prunbauer et al. | 70/358 |
| 5,016,455 | 5/1991 | Hennessy | 70/493 |
| 5,050,412 | 9/1991 | Errani | 70/358 |
| 5,222,383 | 6/1993 | Fann et al. | 70/358 |
| 5,475,998 | 12/1995 | Raskevicius et al. | 70/358 X |
| 5,485,735 | 1/1996 | Laabs et al. | 70/358 |
| 5,553,473 | 9/1996 | Keller | 70/358 |
| 5,617,750 | 4/1997 | Preddey | 70/495 X |

FOREIGN PATENT DOCUMENTS

| | | | |
|---|---|---|---|
| 526276 | 2/1954 | Belgium | 70/356 |

*Primary Examiner*—Suzanne Dino Barrett
*Attorney, Agent, or Firm*—Goldstein & Canino

[57] ABSTRACT

A lock cylinder, operable by a key having key contours which include coded key contours. A cylindrical rotor is rotatably mounted within a stator. A keyway extends longitudinally into the rotor. A plurality of primary pinways extend transverse to the keyway, between the keyway and stator bore. The primary pinways meet the stator bore at a stator plane. A primary pin extends in each of the primary pinways, each primary pin having a contact end and a clearing end. Each primary pin has a coded length which corresponds with one of the coded key contours. At least one cam supports each primary pin in an interfering position where it interferes with rotation of the rotor within the stator when the key is not inserted into the keyway. When the key is inserted in the keyway, the primary pin is allowed to fall and follow the key contours. When the primary pin falls into its corresponding coded key contour, the clearing end of said pin is even with the stator plane, thus allowing the rotor to rotate, and unlocking the lock.

3 Claims, 4 Drawing Sheets

LOCK CYLINDER

BACKGROUND OF THE INVENTION

The invention relates to a lock cylinder. More particularly, the invention relates to a lock cylinder which employs pins which must fall in order for the lock to open.

Most common key locks employ a stator and a rotor. The stator is stationary with respect to the door, and the rotor is capable of rotation in a bore extending through the stator. In such a lock the rotor must rotate in order to unlatch, and thus unlock the lock. However, the rotor is prevented from moving without a properly coded key.

The particular manner in which the rotor is normally prevented from moving, and is selectively allowed to rotate with the correct key, is the subject of this invention. In most typical locks, a series of pins extend in the stator parallel to the keyway, and are spring biased toward the rotor. The pins extend between the stator and rotor, and thus prevent the rotation of the rotor. Secondary pins or varying lengths extend in the rotor adjacent to the keyway. When a key having the proper contours is inserted into the keyway, the contours correspond with the secondary pins, which push the primary pins just far enough to clear the rotor, and to allow the rotor to rotate and unlock the lock.

The problem with the standard lock as described, is that it is relatively easy to "pick". The actual phrase "picking a lock" derives from the fact that a fine metal wire, or "pick" is inserted into the keyway to push the secondary pins upward until the lock opens.

Many techniques have been employed to try to make locks "pick proof". However, these techniques are relatively unsuccessful, because they still employ the same basic lock technology as described above.

While these units may be suitable for the particular purpose employed, or for general use, they would not be as suitable for the purposes of the present invention as disclosed hereafter.

SUMMARY OF THE INVENTION

It is an object of the invention to produce a lock cylinder which is resistant to tampering and picking, and is thus difficult to defeat.

It is a further object of the invention to provide a lock cylinder which has primary pins which normally extend between the rotor and stator and which must fall into the rotor in order for the rotor to be allowed to rotate within the stator to unlock.

It is a still further object of the invention that the pins will only fall when a key of the proper width and having the proper contours is inserted into the keyway.

It is yet a further object of the invention to provide a lock cylinder design that is inexpensive and economical to manufacture.

The invention is a lock cylinder, operable by a key having key contours which include coded key contours. A cylindrical rotor is rotatably mounted within a stator. A keyway extends longitudinally into the rotor. A plurality of primary pinways extend transverse to the keyway, between the keyway and stator bore. The primary pinways meet the stator bore at a stator plane. A primary pin extends in each of the primary pinways, each primary pin having a contact end and a clearing end. Each primary pin has a coded length which corresponds with one of the coded key contours. At least one cam supports each primary pin in an interfering position where it interferes with rotation of the rotor within the stator when the key is not inserted into the keyway. When the key is inserted in the keyway, the primary pin is allowed to fall and follow the key contours. When the primary pin falls into its corresponding coded key contour, the clearing end of said pin is even with the stator plane, thus allowing the rotor to rotate, and unlocking the lock.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
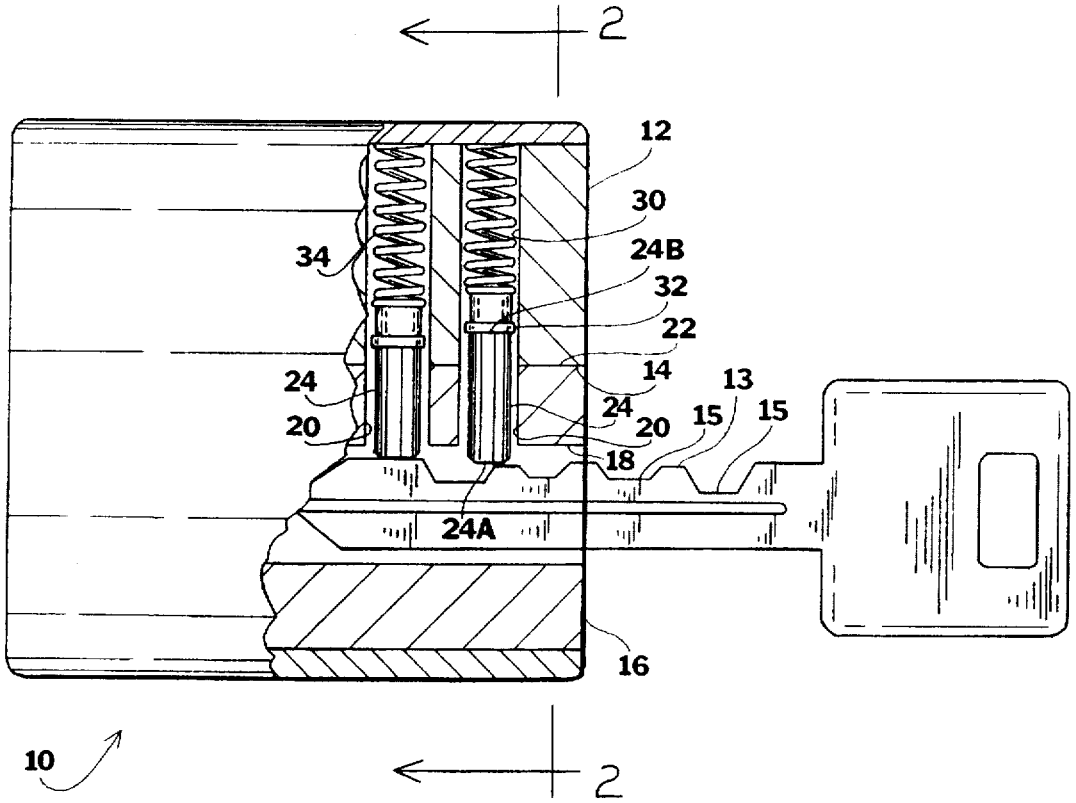
FIG. 1 is a partial cutaway view of a lock cylinder, wherein a key is being inserted into the keyway, and wherein the rotor is prevented from turning by the primary pins which extend upward into the stator.

FIG. 1 illustrates a lock cylinder 10, comprising a stator 12 having a stator bore 14, and a rotor 16 mounted within the stator. The rotor 16 is cylindrical in shape, and is substantially the same in diameter as the stator bore 14 for close rotation therein.

The rotor 16 has a keyway 18 which extends longitudinally into the lock cylinder 10. A key 11 is illustrated inserted into the keyway 18. The key 11 has key contours 13, which include coded key contours 15.

A plurality of primary pinways 20 extend transverse to the keyway 18 and are in direct communication therewith. The primary pinways 20 meet the stator 12 at a stator plane 22 which corresponds to the stator bore 14.

A primary pin 24 extends in each of the rotor pinways 20. The primary pins 24 each have a primary pin diameter, a contact end 24A, and a clearing end 24B. The primary pins 24 each have a coded length which is the distance between the contact end 24A and the clearing end 24B. The coded length of each primary pin 24 may differ in length from the coded lengths of the other primary pins 24.

Illustrated in FIG. 1, the key 11 is being inserted into the keyway 18, and has been inserted past the primary pins 24 illustrated. Thus, for reasons which will be described hereinafter, the primary pins 24 illustrated are free to follow the contours 13 of the key. As illustrated in FIG. 1, the contact ends 24A of the primary pins 24 are not in contact with coded key contours 15 which correspond with the coded lengths of the primary pins 24. Thus, the clearing end 24B is not even with the stator plane 22.

The stator 12 has stator pinways 30 which are normally aligned with the primary pinways 20 when the lock cylinder 10 is in a locked position. A stator pin 32 is present in each of the stator pinways 30, and is biased downward against one of the primary pins 24 with a stator pin spring 34. The slight downward pressure by the stator pin 32, helps push the primary pins 24 against the key 11 so that it follows the contours 13 thereof. But, the stator pins 32 and primary pins 24 are not actually attached.

Figure 5:
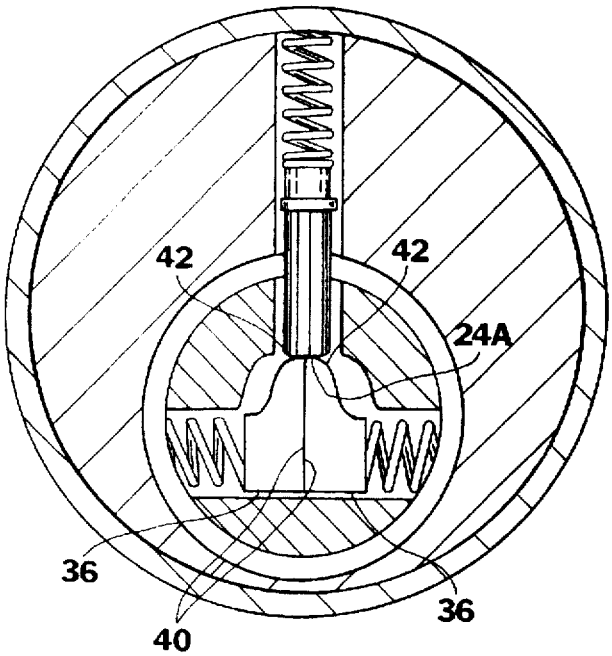
FIG. 5 is a sectional view, similar to FIG. 4, except where the key has been removed from the keyway, and the pins prevent the rotor from moving with respect to the stator.

Referring momentarily to FIG. 5, the key has been removed from the keyway. The keyway is actually closed beneath each of the primary pins by a pair of cams 36 that are biased toward the keyway by a cam spring 38. The cams 36 each have an inner surface 40 which is biased against the inner surface 40 of the other cam 36. The cams 36 also have an upper surface 42 which normally rests against the contact end 24A of one of the primary pins 24. Thus, the upper surfaces 42 of the cams prevent the primary pins from falling and unlocking the lock when the key is not inserted into the keyway.

Figure 2:
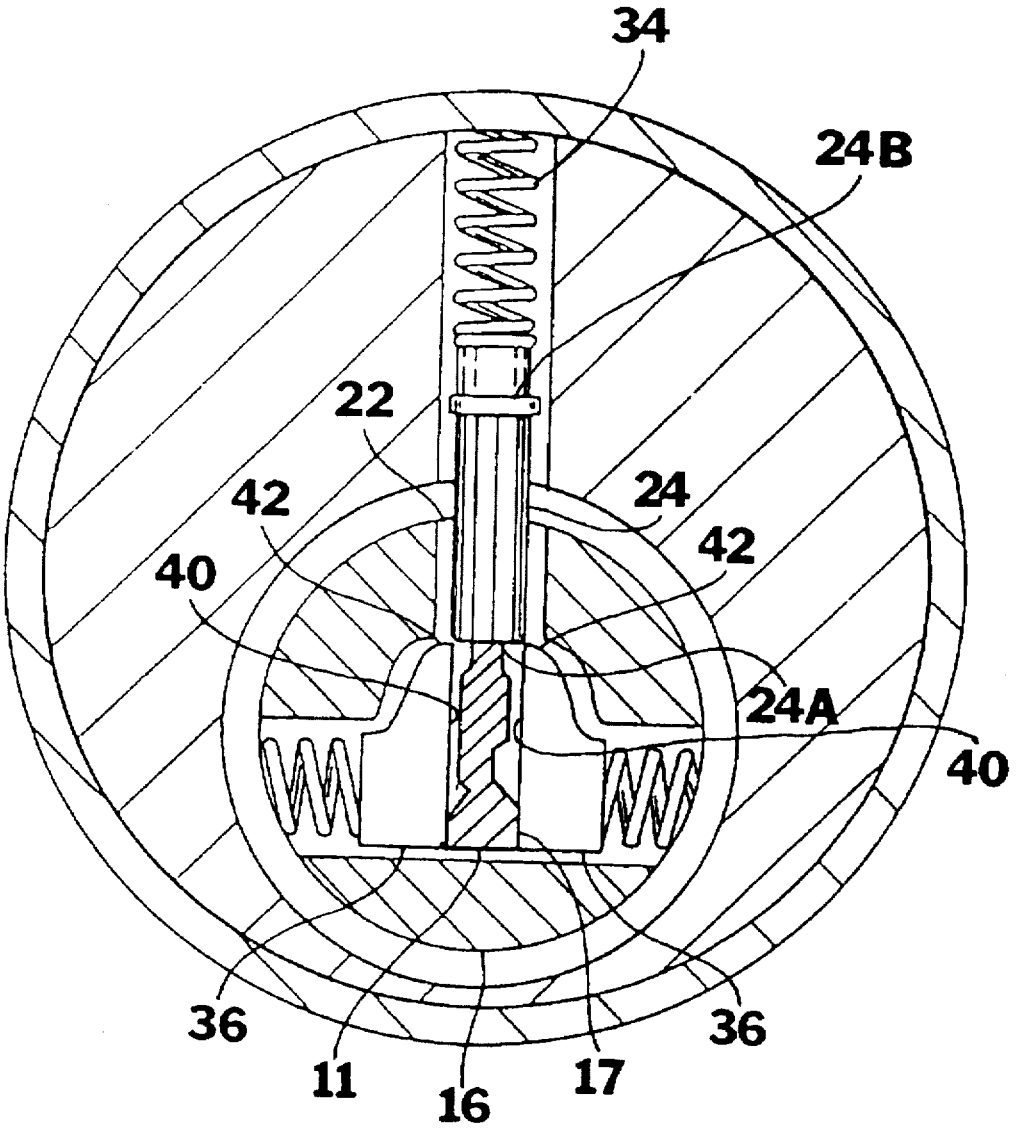
FIG. 2 is a cross sectional view, taken along line 2—2 in FIG. 1, illustrating the keyway with the key partially inserted, forcing the cams apart. The distance between the stator and rotor is greatly exaggerated.

Referring now to FIG. 2, the key 11 has been partially inserted into the keyway 18 as depicted in FIG. 1. Here it can be seen that the cams 36 have been forced apart by the key 11, clearing the upper surfaces 42 of the cam from the contact end 24A of the primary pin 24. Thus, the upper surfaces of the cam 42 no longer support the primary pin 24, which is free to follow the contours of the key 11 under the force of the stator pin spring 34. However, here the primary pin 24 is not contacting a coded contour, and thus, the clearing end 24B of the primary pin 24 still blocks the stator plane 22, and prevents the rotor 16 from turning.

As illustrated in FIG. 2, as long as the inner surfaces 40 are flat, the key 11 must have a widest point 17 which is at least as wide as the primary pin 24 supported by the cam. Otherwise, the primary pin 24 cannot fall, even when the key 11 is inserted. Alternatively the shape of the cam 36 can be varied so that the widest point 17 of the key 11 need not equal the primary pin diameter.

Figure 3:
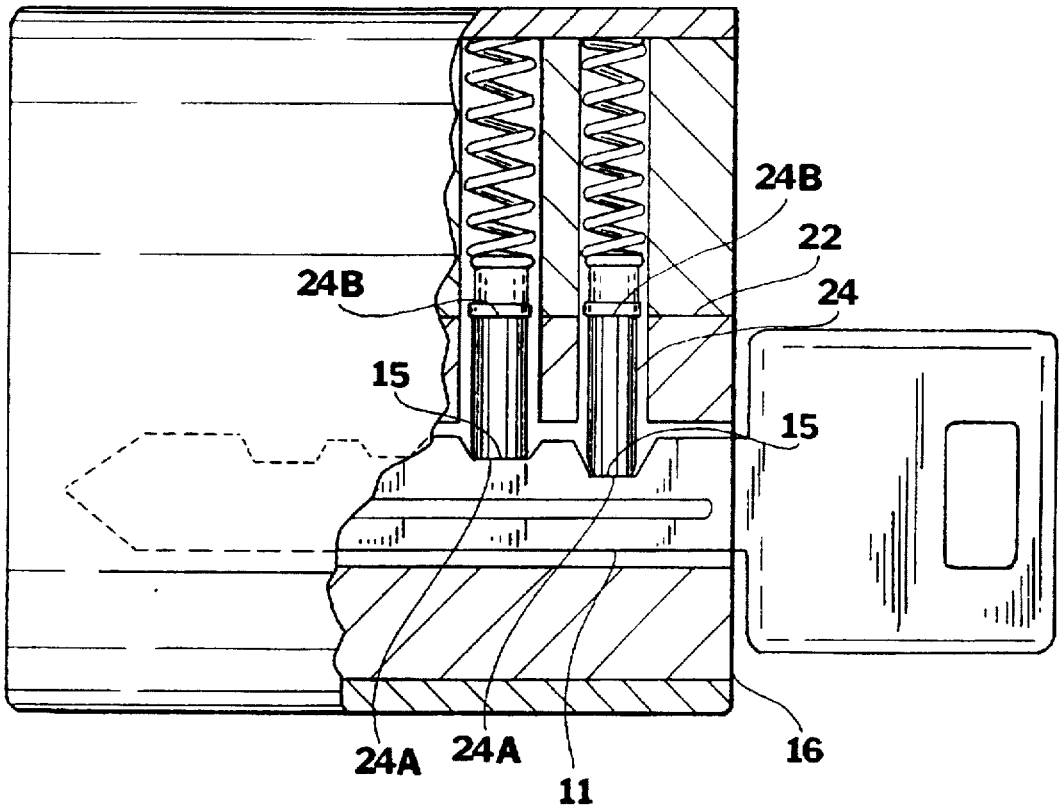
FIG. 3 is a partial cutaway view of the lock cylinder, wherein the key is fully inserted into the keyway, and wherein the pins have fallen into corresponding coded contours of the key, and thus clear the stator.

Next, in FIG. 3, the key 11 has been fully inserted, and the contact ends 24A of the primary pins 24 directly correspond with the coded key contours 15. Thus, the primary pins 24 have fallen to a position where their clearing ends 24B are even with the stator plane 22. Thus, the lock cylinder 10 is effectively unlocked, and the rotor 16 can now turn.

Figure 4:
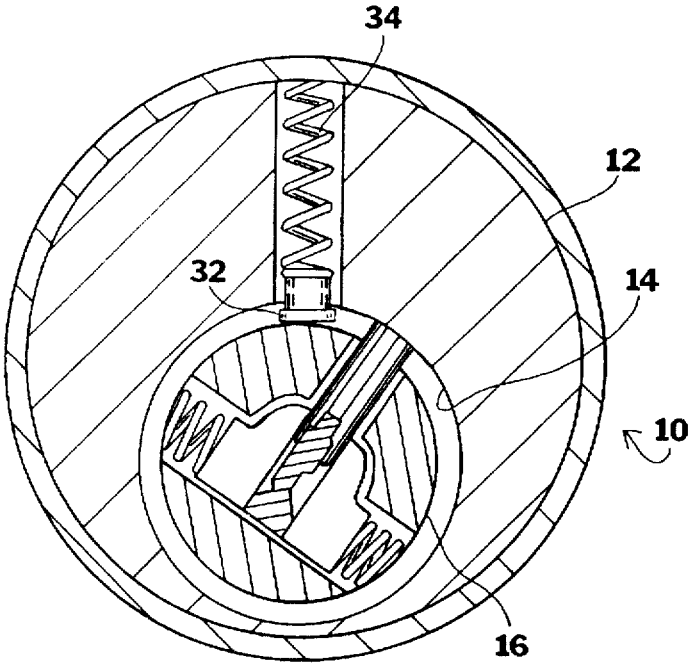
FIG. 4 is a sectional view of the lock cylinder, where the key is fully inserted as in FIG. 3, except wherein the rotor has been rotated.

Referring now to FIG. 4, with the lock cylinder 10 unlocked, the rotor 16 has been turned within the stator 12. The space between the rotor 16 and stator 12 has been greatly exaggerated in part to clearly distinguish these parts, and to show how the stator pins 32 are biased against the rotor 16 by the stator pin springs 34. Normally, the rotor 16 and stator bore 14 are machined to within close tolerances, so that they are nearly the same in diameter.

To summarize the operation of the lock cylinder, primary pins normally extend in primary pinways and stator pinways, across the stator plane to interfere with rotation of the rotor within the stator. A pair of cams extend across the keyway beneath each of the primary pins and bias the primary pins upward. When a key of suitable width is inserted, the cams are forced aside, allowing the primary pins to drop. If all of the primary pins each fall into a coded key contour which corresponds with its coded key length, then the primary pins clear the stator plane, and the rotor is allowed to rotate, thus unlocking the lock cylinder. This system effectively resists lock picking, because it is much more difficult to cause all pins to fall the proper distance using a pick, than it is to push all pins upward as in a conventional lock.

Many variations of the overall concept presented are possible, and are contemplated as being part of the inventive concept. For example, additional interfering pins may be linked to the cams so that the cams themselves can jut outward against the stator when a key of improper width is inserted.

In conclusion, herein is presented a lock cylinder which requires that its primary pins fall into coded contours of a key, instead of being pushed upward by the coded contours as in a conventional lock cylinder. This arrangement makes the lock cylinder of the present invention substantially pick-proof.

What is claimed is:

1. A lock cylinder, operable by a key having key contours which include coded key contours, comprising:

a stator having a stator bore;

a rotor that is cylindrical and rotatably mounted within the stator bore, the rotor having a keyway extending longitudinally along the rotor, the rotor having a plurality of primary pinways in communication with the keyway and meeting the stator bore at a stator plane;

a primary pin extending in each of the primary pinways, each primary pin having a coded length which corresponds with one of the coded key contours, each primary pin having a contact end and a clearing end, when the key is fully inserted into the keyway and the coded key contour is aligned with the contact end of the corresponding primary pin, the clearing end of said primary pin is even with the stator plane and does not interfere with the turning of the rotor within the stator bore; and two cams corresponding to each primary pin, each of said cams has an inner surface which is biased against the inner surface of the other of said cams, the cams having an upper surface which supports the primary pin upward into a position where the primary pin interferes with rotation of the rotor within the stator when the key is not inserted into the keyway.

2. The lock cylinder as recited in claim 1, wherein each primary pin has a primary pin diameter, and the key has a widest point so that insertion of the key forces the cams apart a distance sufficient to allow the primary pin to fall between said cams.

3. The lock cylinder as recited in claim 2, wherein the stator further has a stator pinway corresponding with each primary bore, a stator pin corresponding with each stator pinway, and a stator pin spring which biases the stator pin downward against the primary pin which in turn biases the primary pin downward against the cam when the key is not present beneath said primary pin, and against the key contours when the key is present beneath said primary pin.

* * * * *